US006281855B1

(12) United States Patent
Aoki

(10) Patent No.: US 6,281,855 B1
(45) Date of Patent: Aug. 28, 2001

(54) MONOPULSE ANTENNA APPARATUS

(75) Inventor: Katsuhiko Aoki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/396,431

(22) Filed: Sep. 15, 1999

(30) Foreign Application Priority Data

Jun. 24, 1999 (JP) ..... 11-178019

(51) Int. Cl.[7] ..... H01Q 13/00
(52) U.S. Cl. ..... 343/786; 343/772; 333/21 A
(58) Field of Search ..... 343/786, 840, 343/785, 772; 333/21 A, 126, 135

(56) References Cited

U.S. PATENT DOCUMENTS 3,568,204 * 3/1971 Blaisdell ..... 343/786
3,573,838 * 4/1971 Ajioka ..... 343/783
4,052,724 * 10/1977 Takeichi et al. ..... 343/786
5,617,108 * 4/1997 Silinsky et al. ..... 343/786

FOREIGN PATENT DOCUMENTS 59-8409 1/1984 (JP) .
59-99804 6/1984 (JP) .

* cited by examiner

*Primary Examiner*—Tan Ho
(74) *Attorney, Agent, or Firm*—Rothwell, Figg, Ernst & Manbeck

(57) ABSTRACT

A monopulse antenna apparatus and antenna structure comprising a single horn having four dielectric bars which are internally inserted into the horn and symmetrically positioned along the axis of the horn. Each one end of the bars are fixed to the end wall of a rectangular waveguide and the other end is extending outwardly along the axis of the rectangular waveguide, thus these four dielectric bars are excited by externally applied electromagnetic waves. The four dielectric bars respectively cause the electric field to converge on the bars, and the single horn with four internally inserted dielectric bars acts as if it is partitioned into four horns.

13 Claims, 14 Drawing Sheets

PHASE DETECTION
(RELATIVE PHASE
DIFFERENCE)

0°

PHASE DETECTION
(RELATIVE PHASE
DIFFERENCE)

90°

PHASE DETECTION
(RELATIVE PHASE
DIFFERENCE)

180°

PHASE DETECTION
(RELATIVE PHASE
DIFFERENCE)

270°

(PRIOR ART)

MONOPULSE ANTENNA APPARATUS

BACKGROUND OF THE INVENTION

1. Field of the Invention

The present invention relates to a monopulse antenna apparatus and antenna structure configured by using a single horn.

2. Description of the Prior Art

As a conventional tracking method used in a tracking radar apparatus, a beam switching method or a sequential lobing, and a monopulse method are known. The monopulse method is capable of detecting an angle error by using a single pulse and a four-horn monopulse method is considered to be typical.

Antenna to which the four-horn monopulse method is applied is exemplarily disclosed in Japanese Laid-open publication 59-99804, entitled "monopulse horn antenna apparatus". Japanese Laid-open publication 59-8409, entitled "monopulse antenna" also discloses an antenna of this kind. The monopulse horn antenna apparatus excites or forms, at an aperture of the antenna, a $TE_{10}$ mode wave (TE stands for transverse electric) for at least a sum beam, and a $TE_{20}$ mode wave for a differential mode, as described in a paragraph of "Claims of the Invention" of the specification. In the monopulse horn antenna apparatus, a plurality of horn antennas which can form monopulse beams in the H plane, are arranged in the E plane. For that purpose, a plurality of partitions made of a metallic plate, are inserted into each of these horn antennas in the direction of the H plane, thus forming monopulse beams in both the E plane and H plane.

The above-mentioned monopulse antenna is provided by improving characteristics of each primary horn in a multi-horn configuration. More specifically, the monopulse antenna has an aperture configured by four primary horns, in which a radiation-direction controlling board with a criss-cross shape consisting of a metallic conductor plate, is arranged in parallel with the axis of the antenna, so as to increase the total directivity of the antenna.

Referring to FIGS. 14 to 16, a well-known monopulse antenna adopting a four-horn configuration will be described. FIG. 14 shows a structure of a conventional monopulse antenna of four-horn type, which comprises a main reflector 101, a subreflector 102, a horn 103 consisting of four horns, and a comparator (amplitude comparator) 104 for obtaining sum signals and difference signals which will be described later. FIG. 15 is a perspective view of the horn 103 which is divided or partitioned into four horns, shown as horns A, B, C and D. FIG. 16 is a block diagram of the comparator 104, showing its internal structure.

The comparator as shown in FIG. 16 has hybrid circuits 105 to 108 such as a magic T and the like, for deriving sum signals and difference signals from the four horns. It should be noted that the sum of signals is shown by Σ and the difference of signals is depicted as Δ. Specifically, the comparator 104 produces a sum-signal output Σ 111, denoted by A+B+C+D, and similarly provides a sum-signal output Σ 113, given by ((A+C)−(B+D)).

The comparator 104 also produces a difference-signal output $\Delta A_Z$ 112 denoted by ((A+B)−(C+D)), which is an error signal with respect to the horizontal direction (in the direction associated with the angle of depression). Furthermore, a difference-signal output $\Delta E_1$ 110 expressed by ((A+D)−(B+C)) is provided by the comparator 104, which is an error signal with respect to the vertical direction (in the direction associated with the angle of elevation).

FIG. 17 is a structure of a higher-mode monopulse antenna using a conventional single horn, which is described, for example, in "Handbook of Antenna Engineering" edited by Institute of Telecommunications Engineers, Ohm Publications, a paragraph 9.6.3 (1980). This antenna comprises a main reflector 201, a subreflector 202, a higher-mode detector 204 connected to a single horn 203, and a reference signal detector 205.

The higher-mode detector 204 is, say, a $TM_{10}$ (TM indicates transverse magnetic) mode detector and produces $\Delta A_Z + j\Delta E_1$ as an error signal 207. Note that j indicates the signal phase is shifted in 90°. The reference signal detector 205 comprises, for example, a waveguide with a taper, a circular polarization/linear polarization converter, a circular waveguide ($TE_{11}$)/rectangular waveguide ($TE_{10}$) converter and the like, which are not shown in the figure.

However, the previously described conventional four-horn type monopulse antenna requires four independent horns or four-partitioned horns, which makes the antenna apparatus itself larger in size and brings disadvantages from a cost perspective. Even if the antenna apparatus can be miniaturized, there is a problem that leakage power from the subreflector becomes large and performance of the antenna is deteriorated accordingly.

With respect to the higher-mode monopulse antenna utilizing a conventional single horn, a higher-mode detector generally comprises a mode coupler of multi-aperture type and a combining circuit consisting of a waveguide for coupling outputs from the mode coupler. This kind of monopulse antenna also raises a problem that the antenna apparatus becomes larger in size.

SUMMARY OF THE INVENTION

The present invention aims to solve the problems mentioned above. It is a primary object of this invention to provide a monopulse antenna apparatus and antenna structure capable of preventing antenna performance from deteriorating and of holding down the cost of the apparatus.

It is another object of the present invention to provide a monopulse antenna apparatus and antenna structure which make the apparatus itself small in size.

According to one aspect of the invention, the objects of the invention are achieved by a monopulse antenna apparatus using a single horn, comprising electromagnetic field generating means for generating the electromagnetic field inside of said single horn; and polarization means for causing polarization of distributions of said electromagnetic field to at least four locations which are symmetrical about the axis of said horn.

It is preferable that the apparatus further comprising means for deriving an angular error signal, based on horizontally polarized waves and/or vertically polarized waves generated by said polarization.

It is also preferable that said electromagnetic field generating means is a waveguide and said polarization means consists of four dielectric lines which are symmetrically arranged along the axis of said horn and separated with each other in the angle of 90 degrees, said dielectric lines being excited by said waveguide.

It is preferable that said electromagnetic field generating means is a coaxial cavity and said polarization means consists of four metallic lines which are symmetrically arranged along the axis of said horn and separated with each other in the angle of 90 degrees, said metallic lines forming a central conductor of said coaxial cavity and being excited by said cavity.

According to another aspect of the invention, the objects of the invention are achieved by a monopulse antenna apparatus having a single horn which comprises a main waveguide and at least four subwaveguides, wherein said single horn has at least four openings in its wall which are symmetrically arranged in the circumferential direction of the horn, and each of said subwaveguides is placed on the outer surface of the horn to cover each of said openings, whereby said four subwaveguides and said main waveguide are spatially communicated with each other through said openings, and an angular error signal is obtained based on a signal derived from said subwaveguides.

According to still another aspect of the invention, the objects of the invention are achieved by an antenna structure using a single horn, comprising at least four electromagnetic field generation members arranged in the inner side of said single horn to be symmetrical about the axis of said horn; electromagnetic field polarization members, one end of which is fixed on the end wall of said electromagnetic field generation member located in its axis direction, while the other end is extending along the axis of said electromagnetic field generation member in a predetermined length, said electromagnetic field polarization members being symmetrically arranged about the axis of said horn; and a member for inputting a signal into corresponding inner cavity of said electromagnetic field polarization members.

According to another aspect of the invention, the objects of the invention are achieved by an antenna structure having a single horn which comprises a main waveguide and at least four subwaveguides, said single horn having at least four openings in its wall which are symmetrically arranged in the circumferential direction of the horn, and each of said subwaveguides is placed on the outer surface of the horn to cover each of said openings, whereby said four subwaveguides and said main waveguide are spatially communicated with each other through said openings, said antenna structure further having a member for deriving a signal from said subwaveguides.

BRIEF DESCRIPTION OF THE DRAWINGS

The present invention will become more fully understood by the accompanying drawings which are given by way of illustration only, and thus are not limitative of the present invention, and wherein.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

First Embodiment

Figure 1:
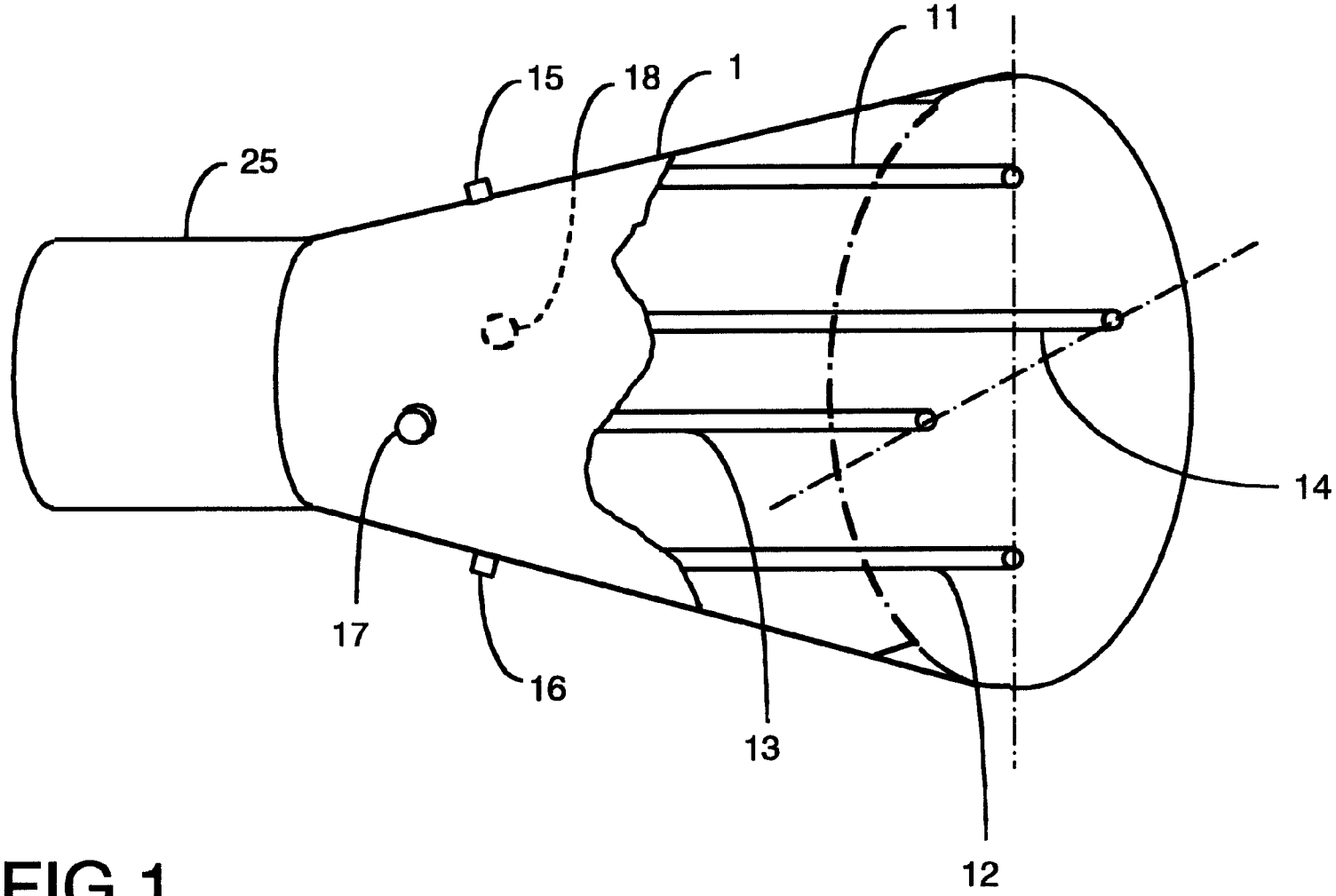
FIG. 1 is a perspective view of substantial part of a monopulse antenna apparatus according to a first embodiment of this invention.

FIG. 1 is a perspective view of a substantial part of a monopulse antenna apparatus according to a first embodiment of this invention, in which the internal structure of the apparatus is shown partly by a break line. As shown in FIG. 1, the monopulse antenna apparatus (hereinafter referred to as the antenna apparatus or simply as the apparatus) comprises a single horn 1 (a conical horn in the present embodiment) and a main waveguide 25 to which the horn 1 is directly connected. Four dielectric bars 11–14 are internally inserted into the horn 1 and one end of each bar is fixed inside of the horn. These four dielectric bars are symmetrically positioned along the axis of the horn, that is, the bars are separately arranged with each other in the angle of 90°. On the outer circumference of the horn 1, coaxial feeders 15–18 serving as a coaxial inputting portion are arranged correspondingly to each of four dielectric bars 11–14 for providing electromagnetic waves from the outside of the apparatus into rectangular waveguides which will be described below.

Because of the symmetry or reversibility of the antenna, the antenna apparatus in the following description is not a receiving antenna, but acts as a transmitting antenna which radiates electromagnetic waves through the horn. It is assumed that the antenna apparatus according to the present embodiment is a monopulse antenna used in the system adopting a circular polarization.

The monopulse antenna apparatus according to the present embodiment is implemented by using a single horn, without employing a circular waveguide of higher mode. For that purpose, the antenna apparatus has a structure in which one horn is equivalently regarded as four horns, which will be described below in detail.

Figure 2B:
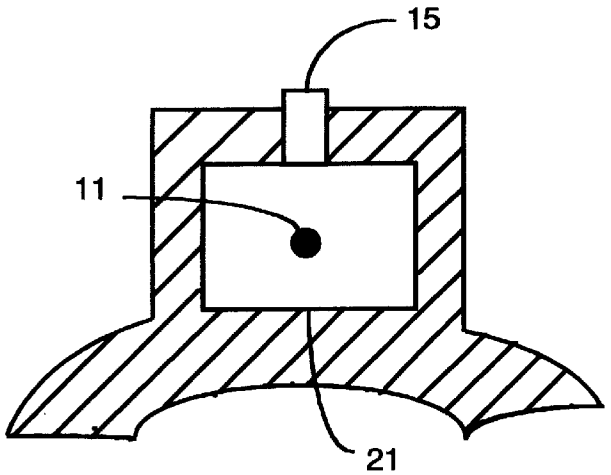
FIGS. 2A and 2B show a detailed structure of the dielectric bars when they are mounted on the apparatus.
Figure 2A:
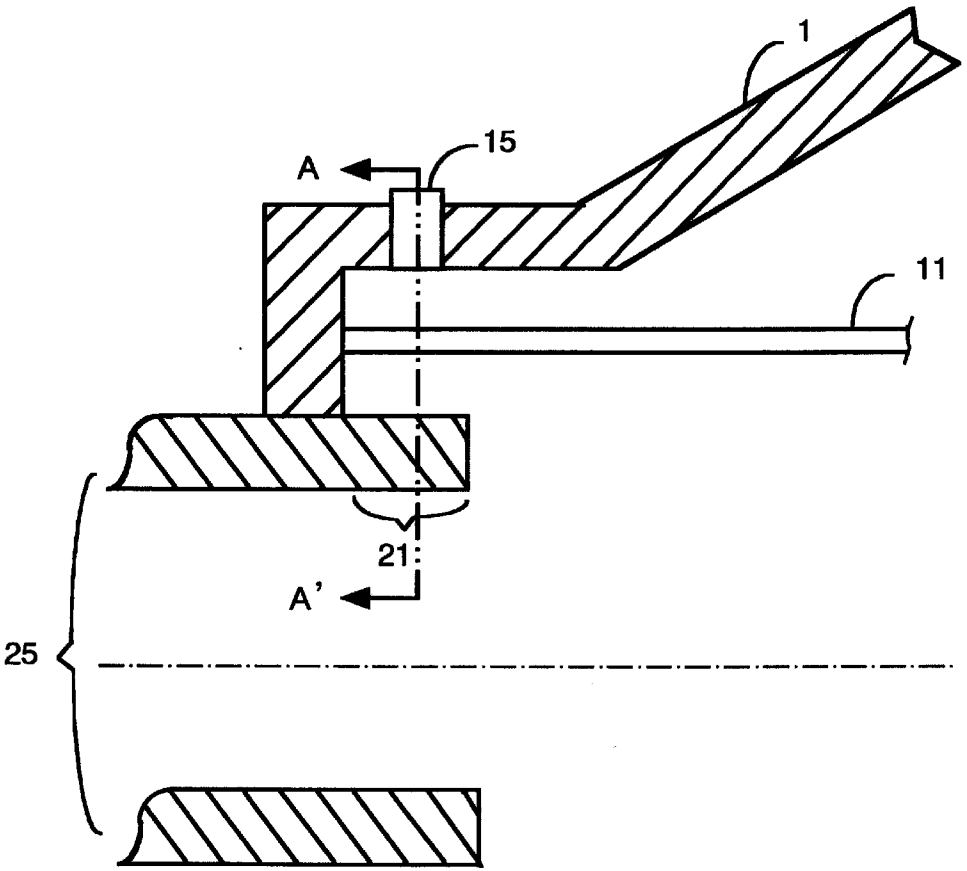

FIGS. 2A and 2B show a detailed structure of the dielectric bars when they are mounted on the apparatus, which characterizes the antenna apparatus of the present invention.

In particular, FIG. 2A is a cross sectional view of the part where the dielectric bar 11, one of four dielectric bars, is mounted. FIG. 2B is a sectional view taken along line A–A' of FIG. 2A. Therefore, the remaining dielectric bars, the bars 12–14, have the same mounting structure as the bar 11.

As shown in FIG. 2A, a rectangular waveguide 21 is formed at the boundary between the main waveguide 25 and the horn 1. One end of the dielectric bar 11 is fixed to the end wall of the inside of the rectangular waveguide 21, and the other end of the dielectric bar 11 is extending outwardly along the axis of the rectangular waveguide 21. Furthermore, on a part of the walls forming the rectangular waveguide 21, that is, on the external wall on the horn side, the coaxial feeder 15 is arranged to provide electromagnetic waves into the rectangular waveguide 21. In the present embodiment, the rectangular waveguide 21 functions as a subwaveguide to excite the dielectric bar 11.

As previously described, inside of the horn 1, four dielectric bars 11–14 are symmetrically positioned along the axis of the horn, therefore, the horn itself acts as if it is partitioned into four horns. In the antenna apparatus according to the present embodiment, distributions of the electromagnetic field inside the horn are concentrated around each of four dielectric bars and are subjected to beam deviation for the axis of the horn. In other words, the antenna apparatus utilizes an effect that the electric field tends to converge on dielectrics which in this case form the dielectric bars. It should be noted that this electric-field convergence effect is a well-known phenomenon, therefore, details of the effect are omitted here.

Figure 3:
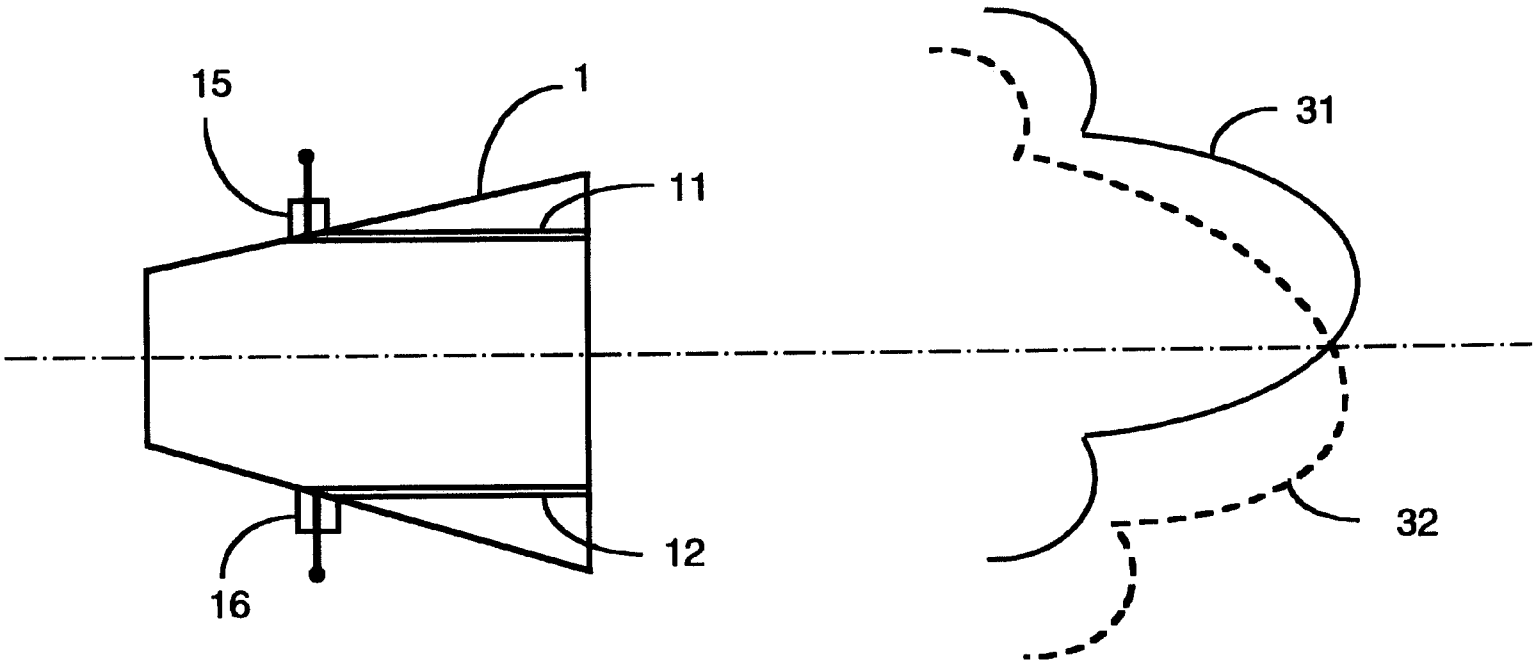
FIG. 3 describes properties of antenna directivity of the antenna apparatus.

FIG. 3 theoretically describes properties of antenna directivity of the antenna apparatus according to the present embodiment, and specifically shows a beam deviation when the dielectric bars 11 and 12 are excited. In FIG. 3, a characteristic curve 31 (shown by a solid line) indicates a beam radiated from the dielectric bar 11 which is excited by electromagnetic waves input via the coaxial feeder 15, while a characteristic curve 32 (shown by a broken line) corresponds to a beam radiated from the dielectric bar 12 which is excited by electromagnetic waves input through the coaxial feeder 16.

Figure 4:
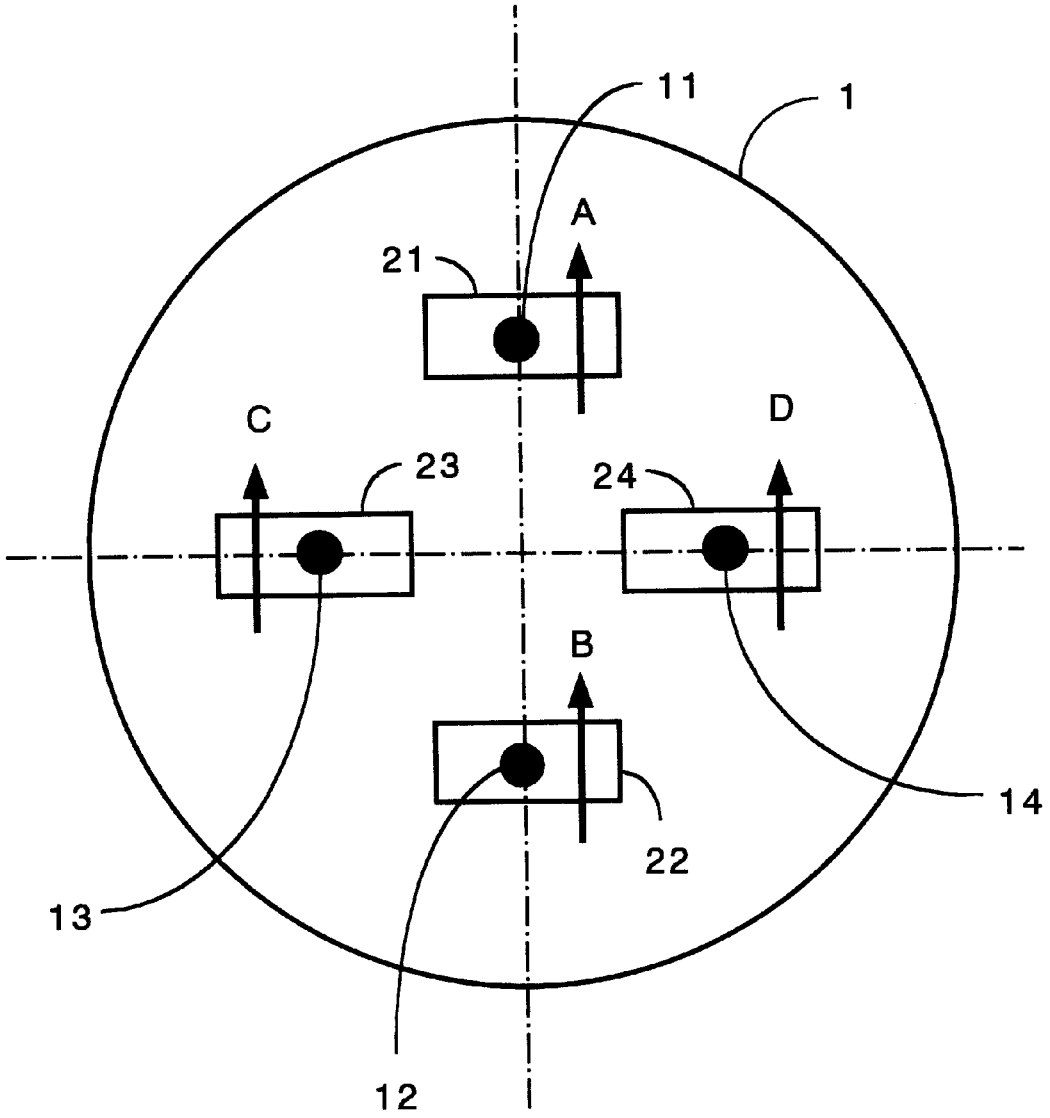
FIG. 4 shows the polarization direction associated with each of the dielectric bars of the antenna apparatus.

FIG. 4 shows the polarization direction associated with each of the dielectric bars of the antenna apparatus. In other words, FIG. 4 is a front view of this antenna apparatus when looking at the apparatus from the rear to the inside of the apparatus in its axial direction. By referring to FIG. 4, it is realized that rectangular waveguides 21–24 are symmetrically arranged for the axis of the horn 1 and the rectangular waveguides respectively have the dielectric bars 11–14 at its center position. Accordingly, the dielectric bars 11–14 being excited as mentioned above are subjected to polarization in the direction as respectively indicated by arrows A, B, C and D. Polarization occurred in the vertical direction on the paper, is called a vertical polarization.

Figure 5A:
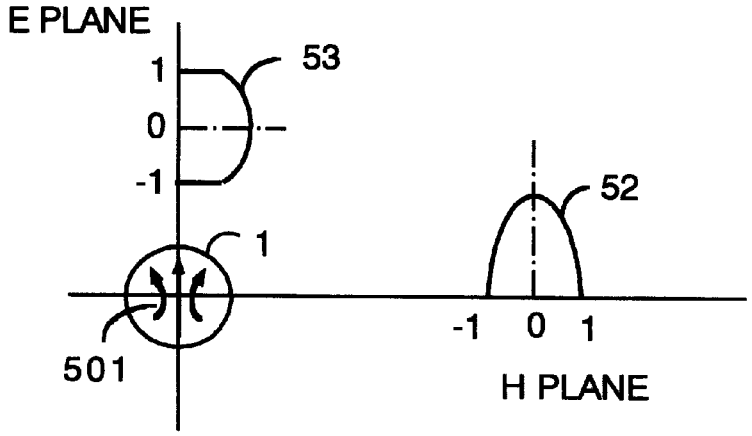
FIGS. 5A to 5C illustrate distributions of the electric field inside of the horn of the antenna apparatus.
Figure 5B:
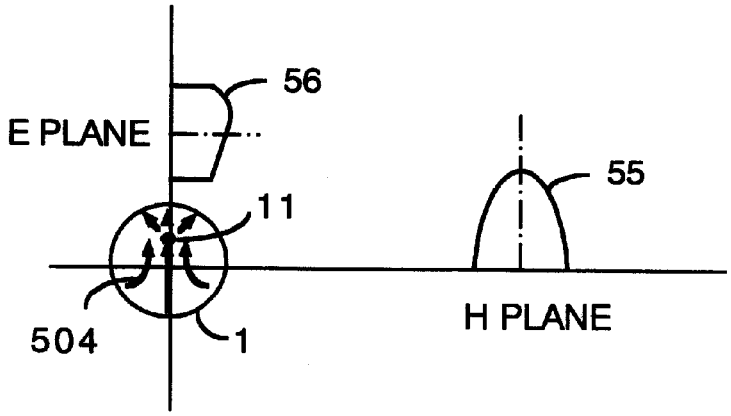
Figure 5C:
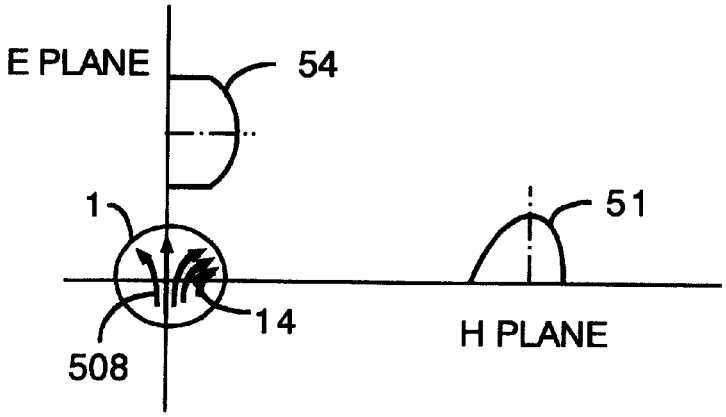

Distributions of the electromagnetic field inside of the horn of the antenna apparatus according to the first embodiment will be described below. FIGS. 5A to 5C illustrate distributions of the electric field inside of the horn of the antenna apparatus, under different conditions. FIG. 5A shows distribution of the electric field associated with a vertical polarization 501 when no dielectric bars are inserted inside of the horn. That is, FIG. 5A depicts distribution of the electric field in the $TE_{11}$ mode in a normal circular waveguide, and distributions corresponding to the H plane and E plane are shown as distributions of the electric field 52 and 53, respectively.

Polarization of the electric field caused by each of the dielectric bars when they are excited inside of the horn, will now be explained. When the dielectric bar 11 is excited in the rectangular waveguide 21, a vertical electric field as indicated with an arrow A of FIG. 4 is provided in the horn. The vertical electric field then converges on the dielectric bar 11 and propagates within the horn. As a result, distributions of the electric field 55 and 56 as shown in FIG. 5B are obtained at the aperture of the horn.

Figure 15:
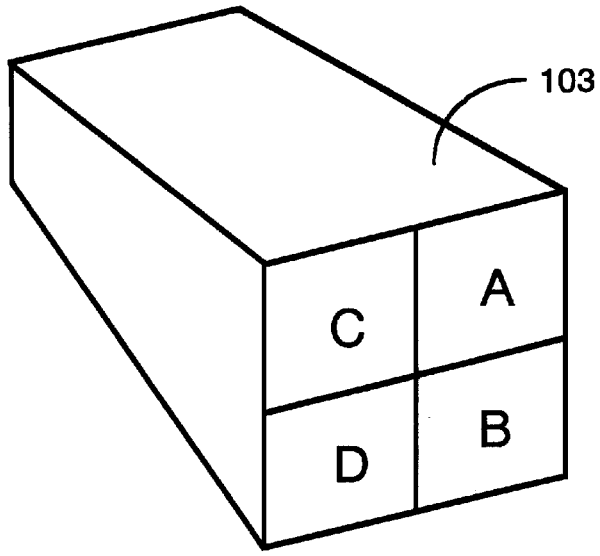
(PRIOR ART) FIG. 15
FIG. 15 is a perspective view of the horn which is divided into four horns.
Figure 16:
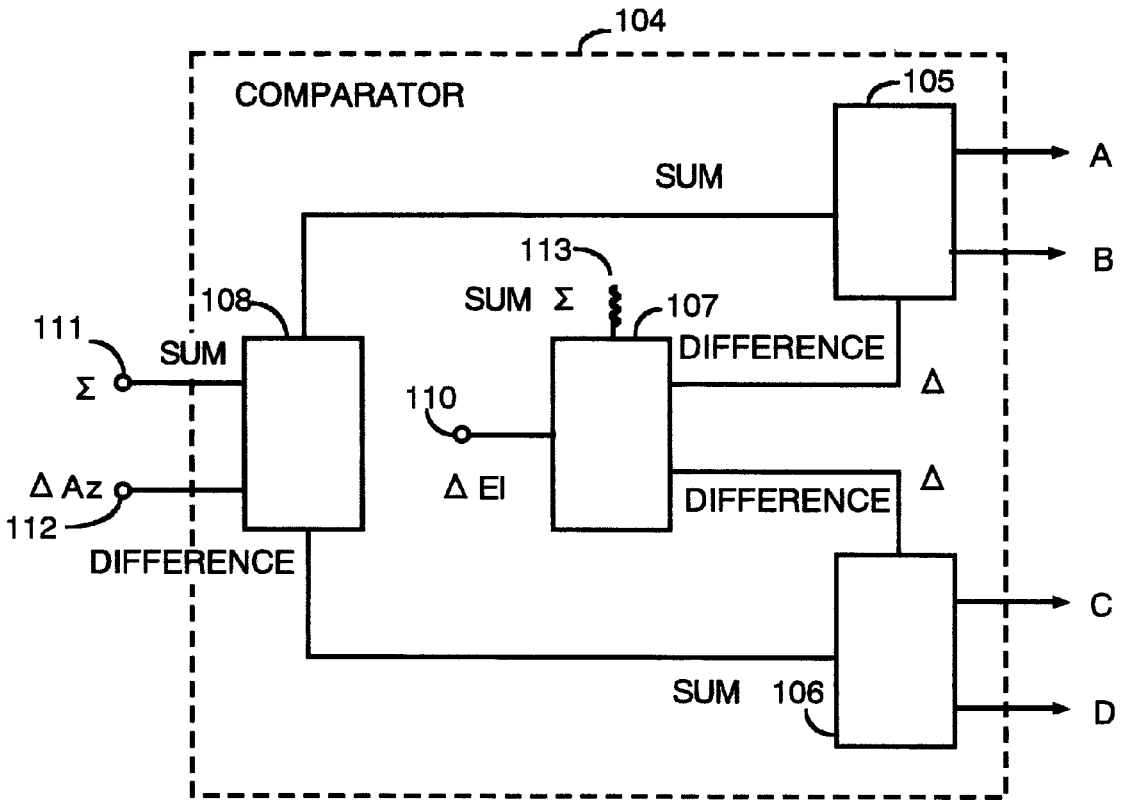
FIG.16 (PRIOR ART)
FIG. 16 is a block diagram of a comparator showing its internal structure.
Figure 17:
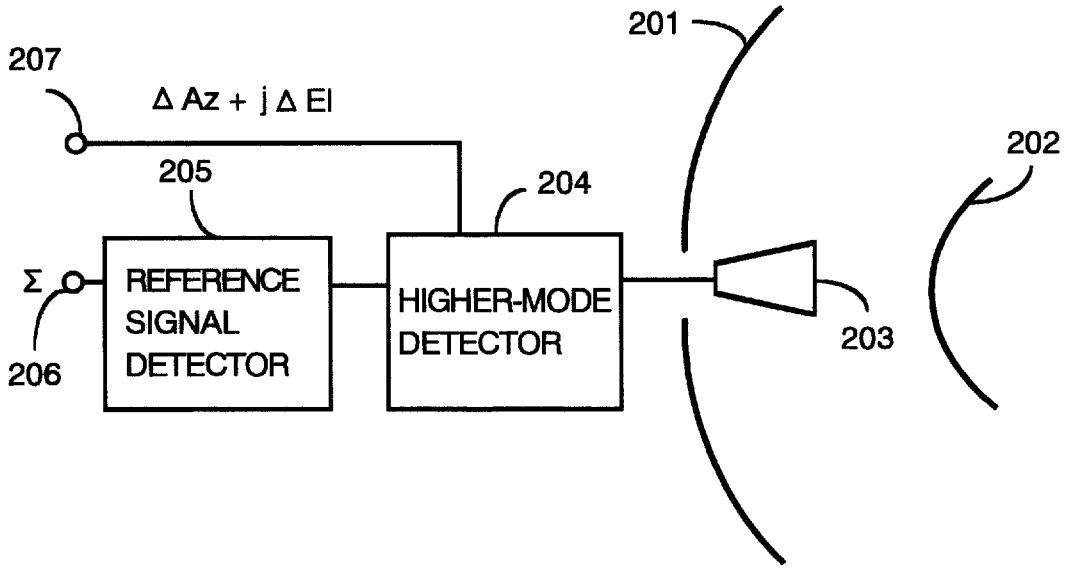
FIG.17 (PRIOR ART)
FIG. 17 is a structure of a higher-mode monopulse antenna using a conventional single horn.

Distributions of the electric field shown in FIG. 5B are those polarized in the E plane (here, it is in the upward direction of the paper). Such distributions can be regarded as distributions equivalent to those of the electric field provided by one of four-partitioned horns, e.g., a horn A as shown in FIG. 15. Distributions of the electric field obtained by exciting the dielectric bar 12 which pairs the bar 11, are equivalent to those provided by one of four-partitioned horns, e.g., a horn D of FIG. 15.

Similarly, when the dielectric bar 14 is excited inside of the rectangular waveguide 24, a vertical electric field as indicated with an arrow D of FIG. 4 is provided in the horn. This excitement causes the vertical electric field to converge on the dielectric bar 14, and results in propagation of the electric field within the horn. Accordingly, distributions of the electric field 51 and 54 as shown in FIG. 5C are obtained, which are equivalent to those provided by one of four-partitioned horns, e.g., a horn C of FIG. 15.

When the dielectric bar 13 pairing the bar 14 is excited in the rectangular waveguide 23, a vertical electric field as shown by an arrow C of FIG. 4 is generated inside of the horn. Distributions of the electric field obtained by such excitement are equivalent to those provided by one of four-partitioned horns, e.g., a horn B of FIG. 15.

As mentioned above, the horn with a structure as shown in FIG. 4 forms a monopulse of four-horn type for a vertical polarization. With respect to a horizontal polarization (its polarized direction is horizontal on the paper), it is generated by a structure in which the rectangular waveguides for exciting each dielectric bar of FIG. 4 are individually rotated in the angle of 90°.

Accordingly, a comparator (not shown) of the antenna apparatus provides an angle-error signal ($\Delta E_1$) in the vertical direction with respect to a vertical polarization, by taking a difference between signals obtained from, for example, the dielectric bars 11 and 12. As for a horizontal polarization, it is capable of obtaining an angle-error signal ($\Delta A_Z$) in the horizontal direction, by taking a difference between signals corresponding, for example, to the dielectric bars 13 and 14.

According to the first embodiment of the present invention, four dielectric bars are internally inserted into a single horn and symmetrically positioned along the axis of the horn, where one end of each bar being fixed to the end wall of a rectangular waveguide and the other end of the dielectric bar extending outwardly along the axis of the rectangular waveguide, then these four dielectric bars are excited by externally applied electromagnetic waves. By adopting this expedient, each of four dielectric bars causes the electric field to converge on the bars, and the single horn with four dielectric bars inserted acts as if it is partitioned into four horns. It is therefore capable of preventing both the horn itself and the antenna apparatus from becoming large in size, thus preventing an antenna performance from deteriorating and providing a small-sized monopulse antenna apparatus with high performance.

The single horn according to the present embodiment is a conical horn. However, the present invention does not impose a limit on that shape. The horn may be a sectoral or pyramidal horn. Moreover, as for the shape of waveguide used for exciting each dielectric bar, it should not be limited on a rectangular one, but it may adopt a circular waveguide.

Figure 6B:
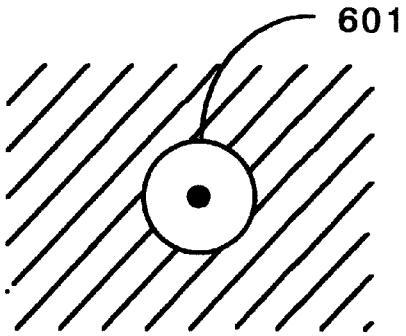
FIGS. 6A and 6B show a detailed structure of the metallic bars when they are mounted in the apparatus.
Figure 6A:
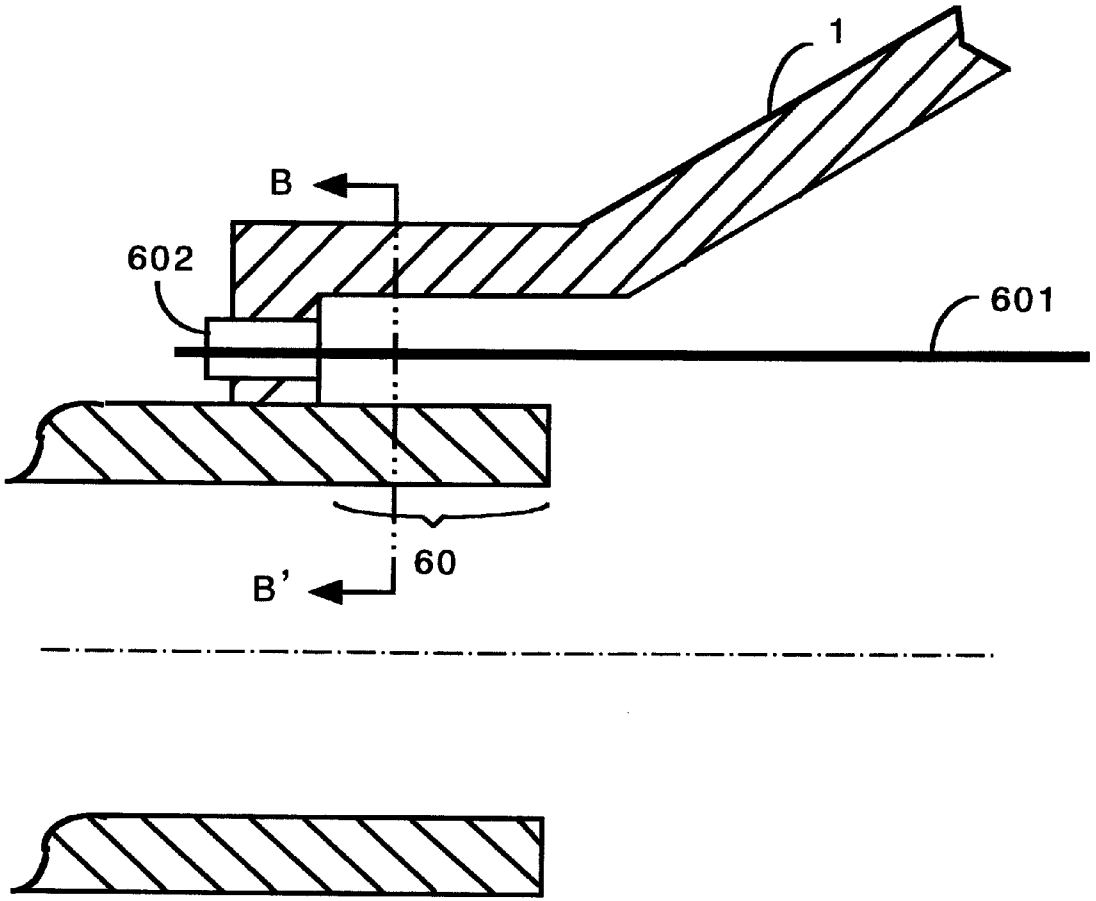

Furthermore, in the present embodiment, four dielectric bars are arranged in a horn so as to implement a beam deviation inside of the horn. However, instead of these dielectric bars, an arrangement may be adopted in which four metallic bars are used for convergence of the electric field. FIGS. 6A and 6B show a detailed structure of the metallic bars of this kind when they are mounted in the apparatus. As shown in FIG. 6A, a coaxial portion 60 is formed in a part of the horn 1, and has a metallic bar 601 as a central conductor of the coaxial portion 60. The bar 601 is extending outwardly in the direction of the horn axis. Coaxial feeder 602 is located on the end wall of the coaxial portion 60 so that a signal can be input through the feeder 602, thus exciting the metallic bar 601 in the coaxial mode.

FIG. 6B is a sectional view taken along line B–B' of FIG. 6A. Since FIG. 6A is a cross sectional view of the portion where only one of four metallic bars, a bar 601, is mounted, the remaining metallic bars have the same structure for mounting a bar as that for the bar 601.

Figure 7A:
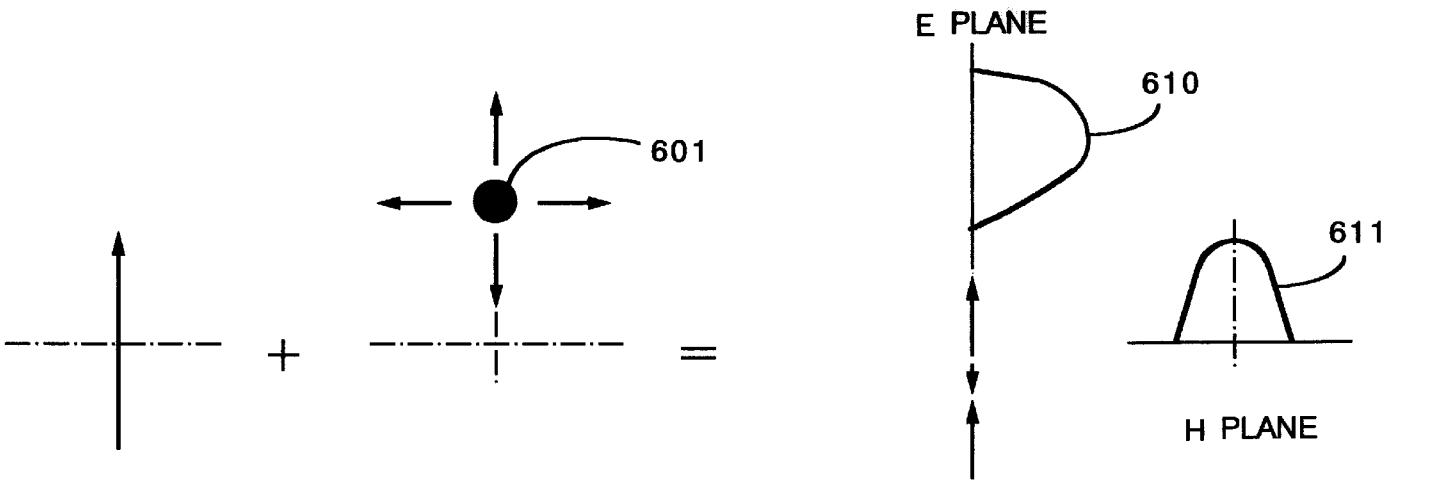
FIGS. 7A and 7B show a beam deviation (distributions of the electric field) when the metallic bars are arranged in a horn.
Figure 7B:
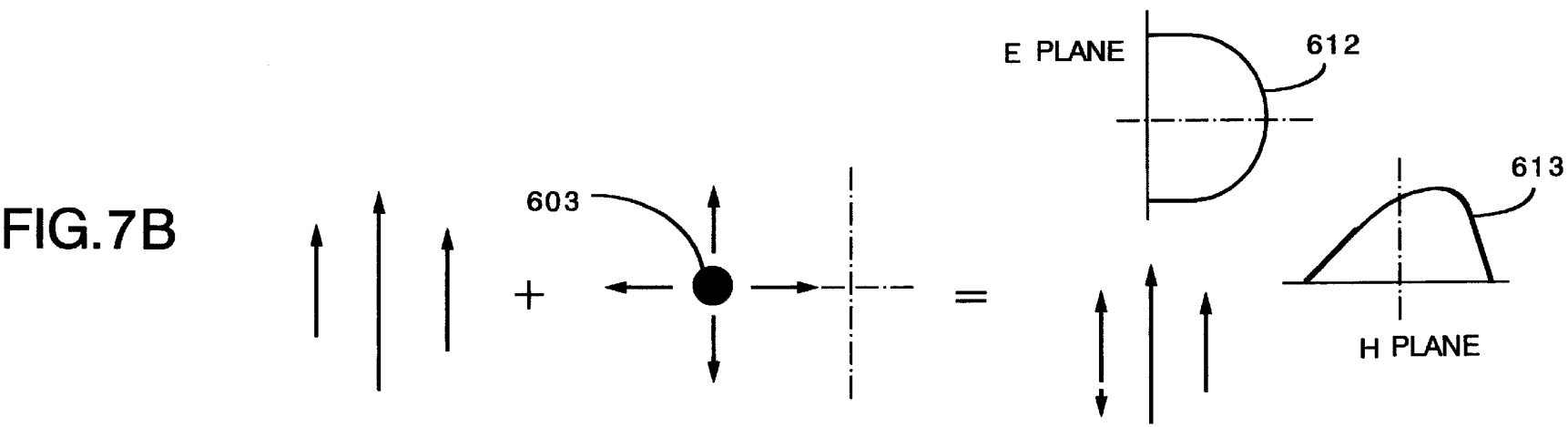

FIGS. 7A and 7B show a beam deviation (distributions of the electric field) when the metallic bars are arranged inside of a horn. FIG. 7A specifically shows distributions of the electric field 610 and 611 in the E plane and H plane, respectively, when the bar 601 is positioned in the E plane. As shown in FIG. 7A, the bar 601 causes distribution of the electric field in the E plane to change as shown by a reference numeral 610. As for a metallic bar 603 positioned in the H plane as shown in FIG. 7B, the bar causes distribution of the electric field in the H plane to change as illustrated by a reference numeral 613.

By changing distributions of the electric field in a single horn in which four metallic bars are symmetrically arranged as stated above, the antenna apparatus acts as if the horn is partitioned into four horns. The horn itself and the apparatus then become compact in size, and are quite inexpensive to construct.

Second Embodiment

Figure 8:
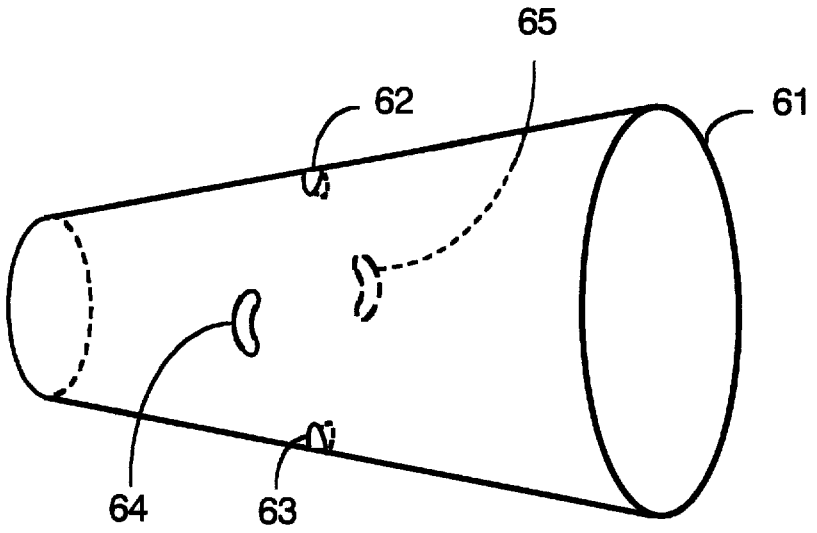
FIG. 8 is a perspective view of a horn which is a part of a monopulse antenna apparatus according to a second embodiment of the present invention.

FIG. 8 is a perspective view of a horn which is a part of a monopulse antenna apparatus according to a second embodiment of the present invention. In the wall of a horn (a single horn) 61 of the antenna apparatus, four slits or slots for coupling (hereinafter referred to as slotted opening) 62–65 are formed and laid out in its circumferential direction as shown in FIG. 8. These slotted openings are used for providing a spatial coupling between rectangular waveguides which will be described later and the inside of the horn.

Figure 9:
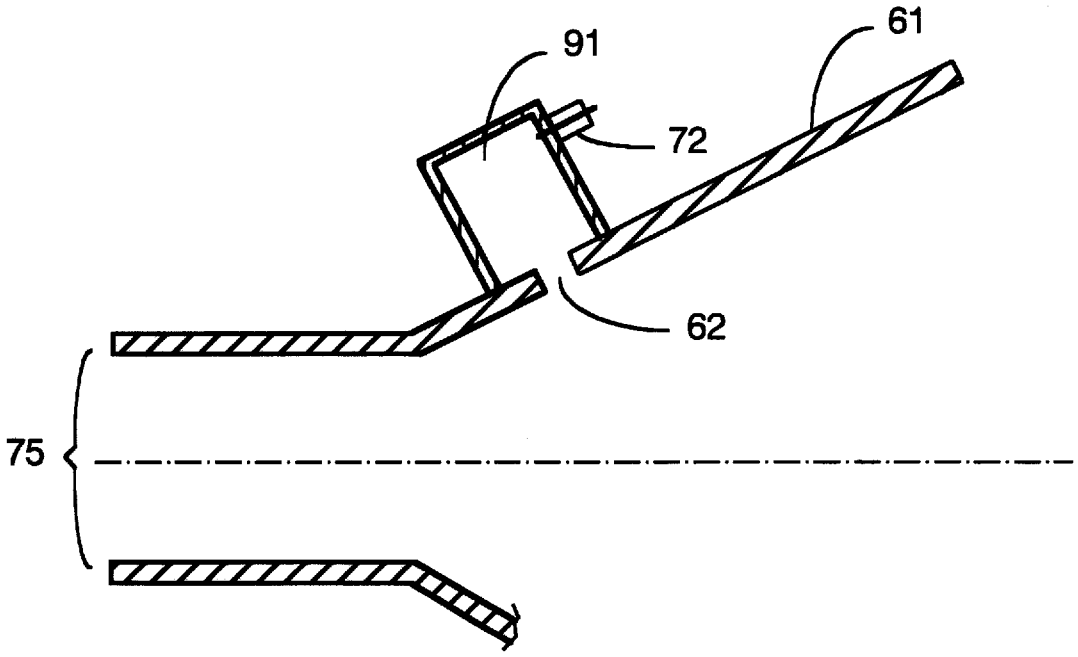
FIG. 9 is a detailed cross sectional view of the slotted openings.
Figure 10:
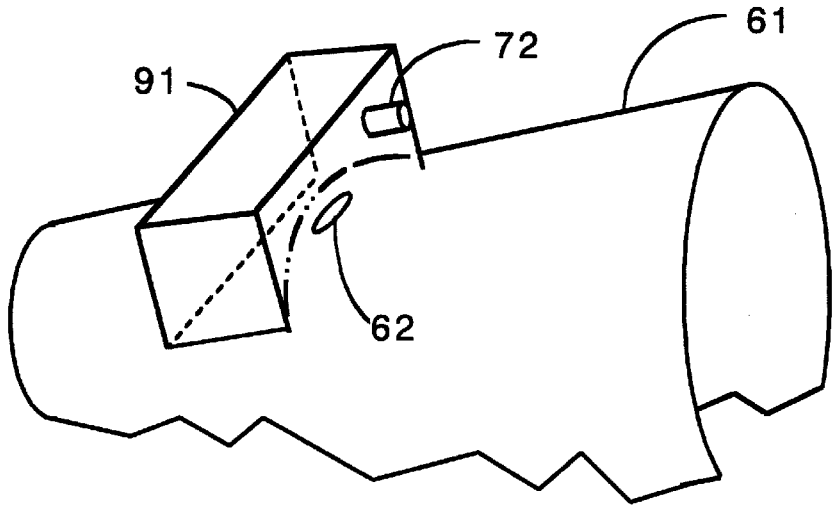
FIG. 10 is a perspective view showing how a rectangular waveguide and the horn are coupled.

FIG. 9 is a detailed cross sectional view of the slotted openings of FIG. 8. FIG. 10 is a perspective view showing how a rectangular waveguide is connected to the horn. As shown in FIG. 9, the slotted opening 62 is formed in the wall of the single horn 61 to which a main waveguide 75 is directly connected. Over the slotted opening 62, a rectangular waveguide 91 is arranged to closely contact to the outer surface of the horn 61. The rectangular waveguide 91 and the inside of the horn are spatially communicated through this opening with each other. The rectangular waveguide 91 has a coaxial output portion 72 for deriving a signal output.

It should be noted that FIG. 9 simply shows a cross sectional view of the slotted opening 62 and its environs, however, the remaining slotted openings, openings 63 to 65, have the same structure as the opening 62. One of the characterizing features of the antenna apparatus according to the second embodiment of the present invention is that the horn 61 and the rectangular waveguide 91 are coupled with each other in their H plane.

The reason for placing these slotted openings 62–65 on the horn 61 in their circumferential direction is that differentiation of a mode is taken into consideration between the $TE_{11}$ mode in a circular waveguide, which is the main mode inside of the horn 61, and the $TM_{01}$ mode as a higher mode. In other words, the openings are formed and laid out in the circumferential direction of the horn so that the $TM_{01}$ mode is excited via these openings as a higher mode of the lowest mode in the circular waveguide 75.

In the present embodiment, since no current flows in the inner wall of the waveguide in its axial direction, the $TE_{11}$ mode, which is a basic mode, is not excited via the slotted openings. This comes from the shape of the openings which are formed to have a slit in the circumferential direction of the horn. Accordingly, only the $TM_{01}$ mode is excited without exerting any influence on the $TE_{11}$ mode which is a propagation mode of a reference signal.

Figure 11:
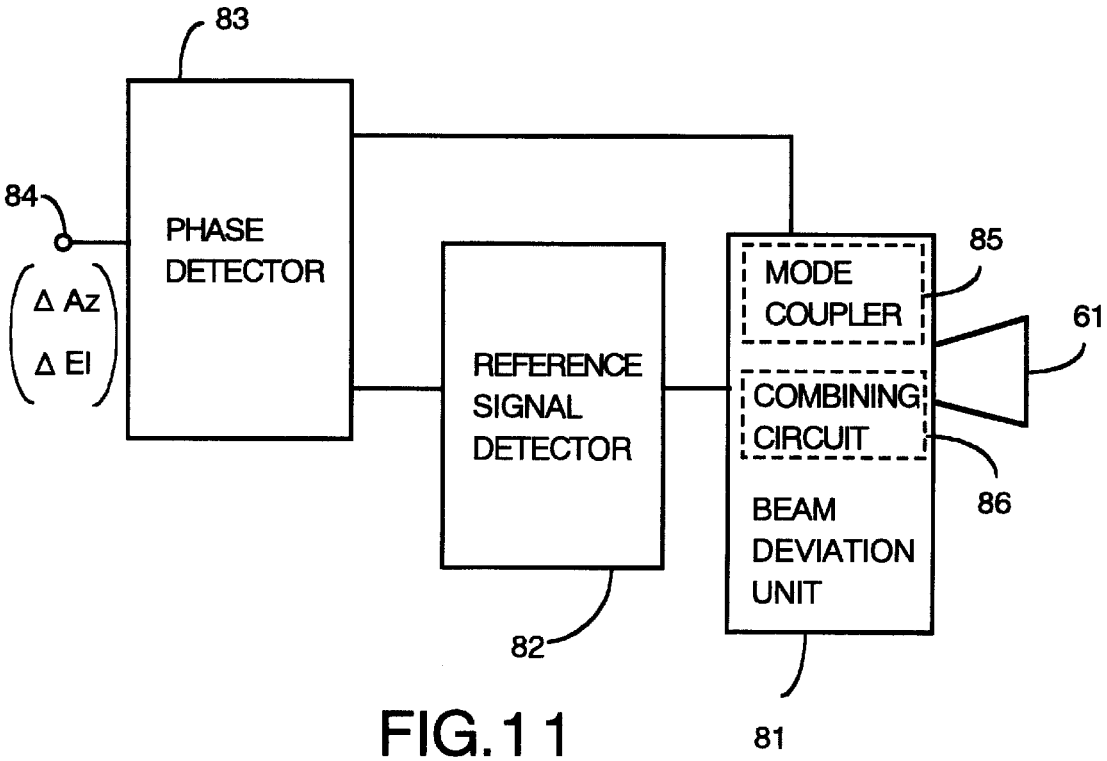
FIG. 11 is a block diagram illustrating the whole of the antenna apparatus according to a second embodiment of the present invention.

FIG. 11 is a block diagram illustrating the whole of the antenna apparatus according to the second embodiment of the present invention. The antenna apparatus comprises the single horn 61, a $TM_{01}$ mode coupler 85, a combining circuit 86, a beam deviation unit 81 consisting of the coupler 85 and the circuit 86, a reference signal detector 82 located in the next stage of the beam deviation unit 81 and a phase detector 83 for performing a phase detection on an error signal sent from the beam deviation unit 81 by using a reference signal from the reference signal detector 82, thus deriving desired outputs (error signals $\Delta E_1$ and $\Delta A_Z$ which will be described later) from an output terminal 84.

Figure 12A:
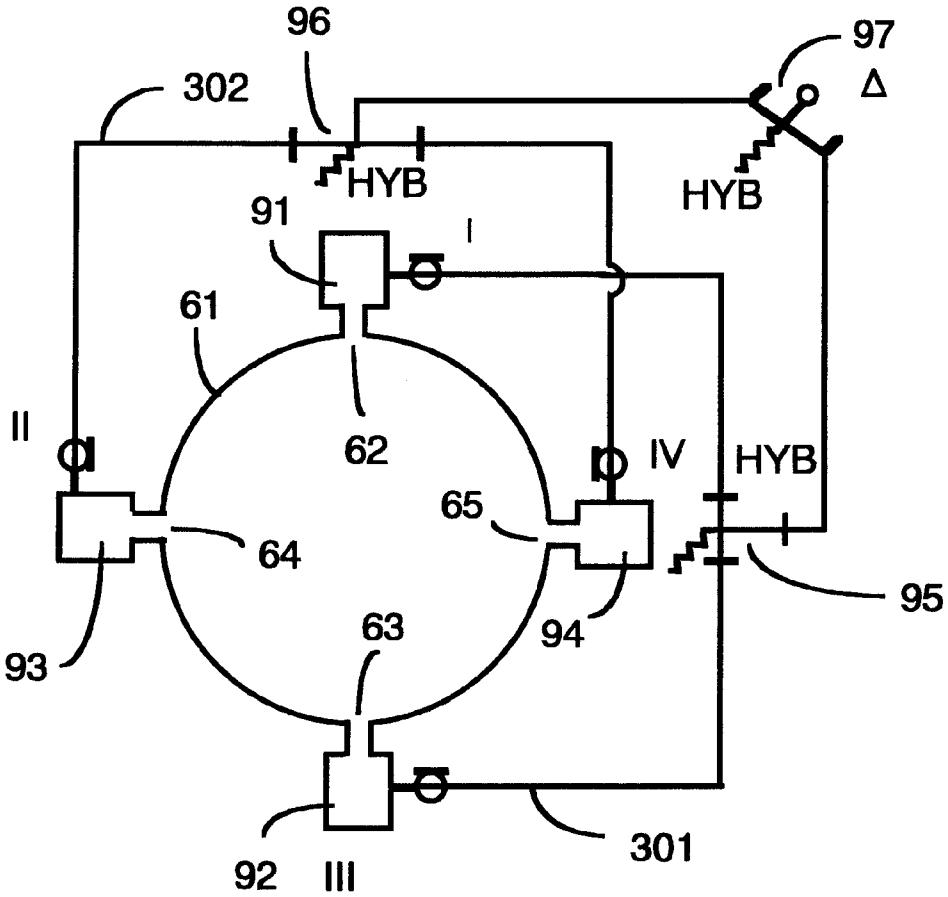
FIGS. 12A and 12B are a detailed structure of a combining circuit.
Figure 12B:
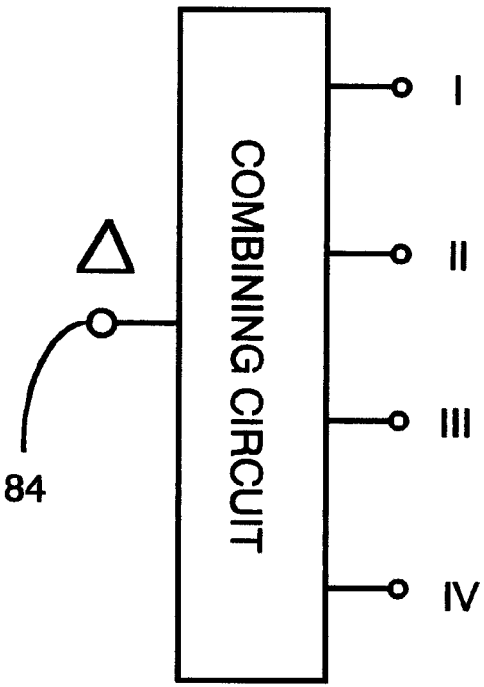
Figure 13A:
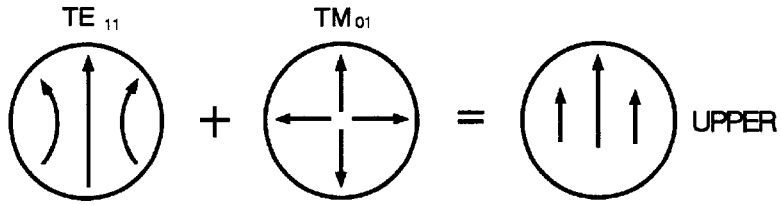
FIGS. 13A to 13D illustrate deviations of the electric field in a horn of the antenna apparatus according to the second embodiment of the invention.
Figure 13B:
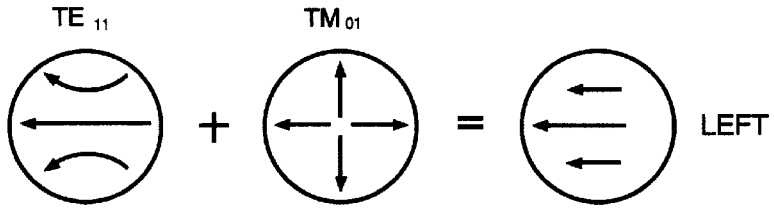
Figure 13C:
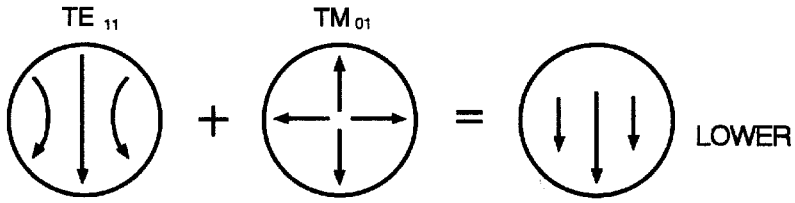
Figure 13D:
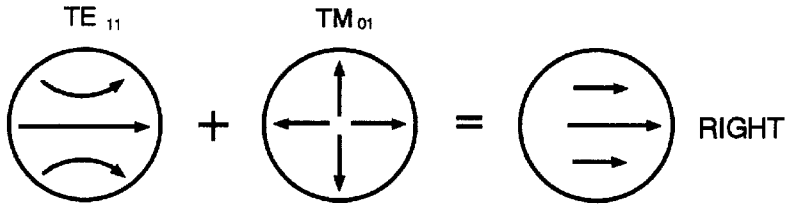
Figure 14:
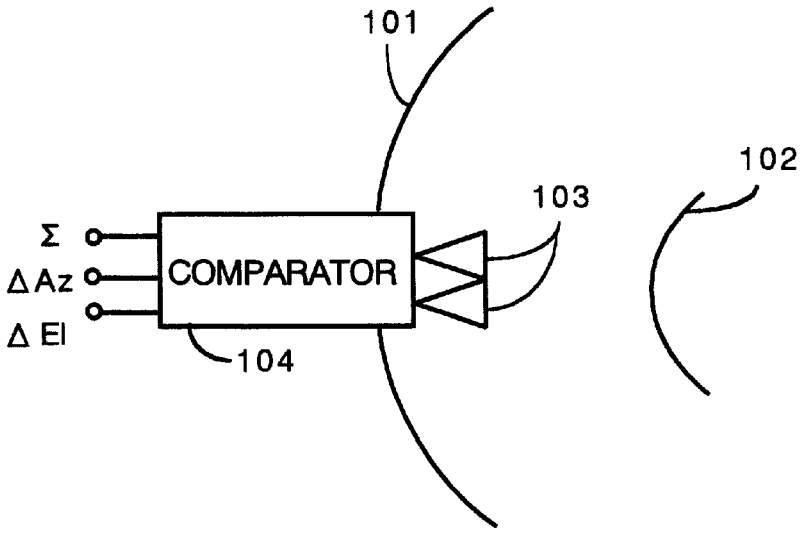
FIG. 14 shows a structure of a conventional monopulse antenna of four-horn type.

FIGS. 12A and 12B are a detailed structure of the combining circuit 86. FIG. 12A is related to a configuration for combining signals. As shown in FIG. 12A, rectangular waveguides 91–94 coupled to the inside of the horn 61 through the slotted openings 62–65 as described above, provide four output signals I, II, III and IV. Among these signals, the signals I and III are combined by a hybrid circuit (HYB) 95 of a coaxial type located midway of a coaxial transmission line 301.

Similarly, the signals II and IV are combined by a hybrid circuit (HYB) 96 located midway of a coaxial transmission line 302. Signals combined by the HYBs 95 and 96 are further combined by a hybrid circuit (HYB) 97. Three hybrid circuits, the HYBs 95, 96 and 97, thus combine outputs from the rectangular waveguides 91–94 which act as a subwaveguide. The combined signal is then output from the output terminal 84 as an error signal, as shown in FIG. 12B.

FIGS. 13A to 13D illustrate deviations of the electric field in a horn of the antenna apparatus according to the second embodiment of the invention. More specifically, FIGS. 13A to 13D show deviations of the electric field when an inner-waveguide deviation of the electric field associated with a circular waveguide in the $TE_{11}$ mode and that associated with a circular waveguide in the $TM_{01}$ mode are combined, corresponding to degrees of a phase detection (relative phase difference). As shown in these figures, the $TM_{01}$ mode is a mode which is symmetrical about the axis, while the $TE_{11}$ mode is related to a circular polarization and the plane of polarization is rotating as time passes by. With respect to each instantaneous polarization of the circular polarization, in which linear polarization is rotating at the angular frequency in radians per second represented by $\omega=2\pi f$ (where f is a frequency), a beam deviation takes place as time passes by, as shown in FIGS. 13A to 13D.

Accordingly, when an error signal is phase-detected in the $TE_{11}$ mode as a reference mode in every 90 degrees in angle, that is, 0°, 90°, 180° and 270°, signals are provided with polarization in the upper, left, lower and right directions for the paper, as respectively shown in FIGS. 13A to 13D. When a difference is taken between the detected signal corresponding to 0° and that to 180°, an error signal with respect to the vertical direction (upper and lower directions) ($\Delta E_1$) can be obtained. When a difference is taken in like manner between the detected signal corresponding to 90° and that to 270°, an error signal with respect to the horizontal direction (right and left directions) ($\Delta A_Z$) is derived.

In the second embodiment as described above, four slotted openings are formed in the wall of a single horn and laid out in its circumferential direction, and four rectangular waveguides are arranged on the outer surface of the horn to cover the openings, so that the rectangular waveguides and the inside of the horn are spatially communicated through these openings. In such an arrangement, when the waveguides are excited via the openings, an error signal is obtained based on a combination result of signals output from each of the rectangular waveguides. Thus, it is provided a monopulse antenna apparatus and antenna structure with a horn in small size, and at the same time, it is capable of preventing deterioration of antenna performance and a raise in the cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A monopulse antenna apparatus using a single horn comprising:

a waveguide for generating an electromagnetic field inside of said single horn; and four dielectric lines which are symmetrically arranged along the axis of said horn and separated with each other in the angle of 90 degrees, said dielectric lines being excited by said waveguide, for causing polarization of distributions of said electromagnetic field to at least four locations which are symmetrical about the axis of said horn;

further comprising means for deriving an angular error signal, based on horizontally polarized waves and/or vertically polarized waves generated by said dielectric lines.

2. A monopulse antenna apparatus using a single horn comprising:

waveguide means for generating an electromagnetic field inside of said single horn; and four dielectric lines which are symmetrically arranged along the axis of said horn and separated from each other by an angle of 90 degrees, said dielectric lines being selectively excited by said waveguide means, for causing polarization of distributions of said electromagnetic field to a selected one of at least four locations which are symmetrical about the axis of said horn.

3. The apparatus according to claim 2, wherein said single horn is a conical horn.

4. The apparatus according to claim 2, wherein said single horn is a pyramidal horn.

5. The apparatus according to claim 2, wherein said waveguide is a rectangular waveguide.

6. The apparatus according to claim 2, wherein said waveguide is a circular waveguide.

7. A monopulse antenna apparatus having a single horn which comprises a main waveguide and at least four subwaveguides, wherein said single horn has at least four openings in its wall which are symmetrically arranged in the circumferential direction of the horn, and each of said subwaveguides is placed on the outer surface of the horn to cover each of said openings, whereby said four subwaveguides and said main waveguide are spatially communicated with each other through said openings, and an angular error signal is obtained based on a signal derived from said subwaveguides.

8. The apparatus according to claim 7, wherein said main waveguide is connected to a reference signal detector from which a reference signal is derived, whereby a phase detection is performed on said angular error signal based on said reference signal.

9. The apparatus according to claim 8, wherein said four subwaveguides and said openings are symmetrically arranged along the axis of said horn and separated with each other in the angle of 90 degrees.

10. The apparatus according to claim 9, wherein said phase detection is performed in the angles of 0°, 90°, 180° and 270° with respect to said reference signal.

11. The apparatus according to claim 7, wherein said openings are slot-type openings extending in the circumferential direction of the horn.

12. The apparatus according to claim 7, wherein said subwaveguides are rectangular waveguides, and each of said rectangular waveguides is coupled with said horn in the H plane.

13. An antenna structure using a single horn comprising:

at least four electromagnetic field generation members arranged in the inner side of said single horn to be symmetrical about the axis of said horn;

electromagnetic field polarization members, one end of which is fixed on the end wall of said electromagnetic field generation member located in its axis direction, while the other end is extending along the axis of said electromagnetic field generation member in a predetermined length, said electromagnetic field polarization members being symmetrically arranged about the axis of said horn; and a member for inputting a signal into corresponding inner cavity of said electromagnetic field polarization members.

* * * * *